US008424990B2

(12) United States Patent
Okada et al.

(10) Patent No.: US 8,424,990 B2
(45) Date of Patent: Apr. 23, 2013

(54) PRINTER AND CONTROL METHOD THEREOF

(75) Inventors: Yoshiyuki Okada, Inashiki-gun (JP); Asayo Nishimura, Inashiki-gun (JP)

(73) Assignee: Riso Kagaku Corporation, Tokyo (JP)

( * ) Notice: Subject to any disclaimer, the term of this patent is extended or adjusted under 35 U.S.C. 154(b) by 830 days.

(21) Appl. No.: 12/314,079

(22) Filed: Dec. 3, 2008

(65) Prior Publication Data

US 2009/0147040 A1 Jun. 11, 2009

(30) Foreign Application Priority Data

Dec. 6, 2007 (JP) ..... 2007-316026

(51) Int. Cl.
*B41J 29/38* (2006.01)

(52) U.S. Cl.
USPC ..... 347/14

(58) Field of Classification Search ..... 347/14
See application file for complete search history.

(56) References Cited

U.S. PATENT DOCUMENTS

| | | | | |
|---|---|---|---|---|
| 2005/0225604 | A1* | 10/2005 | Silverbrook | 347/54 |
| 2006/0152541 | A1* | 7/2006 | Isozaki et al. | 347/17 |

FOREIGN PATENT DOCUMENTS

| | | |
|---|---|---|
| JP | 04-250060 | 9/1992 |
| JP | 10-175315 | 6/1998 |
| JP | 10-278309 | 10/1998 |
| JP | 11-020158 | 1/1999 |
| JP | 2002-019103 | 1/2002 |
| JP | 2004-001435 | 1/2004 |
| JP | 2004-034455 | 2/2004 |
| JP | 2004-276486 | 10/2004 |
| JP | 2006-88575 | 4/2006 |

* cited by examiner

*Primary Examiner* — Uyen Chau N Le
*Assistant Examiner* — Hoang Tran
(74) *Attorney, Agent, or Firm* — Nath, Goldberg & Meyer; Jerald L. Meyer; Sanjana Mangalagiri

(57) ABSTRACT

An inkjet printer includes an inkjet head configured to perform printing on a printing sheet by use of ink. The inkjet printer includes: a heater configured to heat the ink; a thermometer configured to measure the temperature of the ink; and a controller configured to control the amount of electric power to be supplied to the heater and to control the inkjet head. In a case where the measured value of the ink temperature measured by the thermometer is in a range of a first reference temperature inclusive to a second reference temperature exclusive, the controller calculates a coverage rate of a page to be printed, and accordingly changes the amount of electric power to be supplied to the heater depending on the coverage rate thus calculated.

20 Claims, 7 Drawing Sheets

PRINTER AND CONTROL METHOD THEREOF

CROSS REFERENCE TO RELATED APPLICATION

This application is based upon and claims the benefit of priority from the prior Japanese Patent Application No. 2007-316026, filed on Dec. 6, 2007, the entire contents of which are incorporated herein by reference.

BACKGROUND OF THE INVENTION

1. Field of the Invention

The present invention relates to an inkjet printer and a control method thereof, and particularly to an ink temperature controlling mechanism and an ink temperature controlling method of the inkjet printer.

2. Description of the Related Art

As described in Japanese Unexamined Patent Publication No. 2004-276486, a temperature range for guaranteeing the ink performance is specified for an inkjet printer for the purpose of obtaining a better printing result. Therefore, there have been practically-used inkjet printers each including a heater for heating ink, and thus causes the heater to heat the ink when a lower ambient temperature makes the ink temperature lower than the temperature range for guaranteeing the ink performance.

Such an inkjet printer does not start its printing operation until the temperature of the ink rises to the temperature range for guaranteeing the ink performance. When the ambient temperature is low, the inkjet printer spends time to heat the ink, and then starts the printing operation. Particularly, the inkjet printer described in Japanese Unexamined Patent Publication No. 2006-088575 is of an ink-circulation type which circulates its ink. The inkjet printer of the ink-circulation type requires a longer time to heat the ink than an inkjet printer of a non-circulation type, because the inkjet printer of the ink-circulation needs to heat all of the circulated ink.

The inkjet printer including a heater is designed to continue heating the ink for a while until the temperature of the ink reaches a predetermined reference temperature, even after the inkjet printer completes heating the ink up to a lower limit value of the temperature range for guaranteeing the ink performance. Thereby, the inkjet printer prevents the temperature of the ink from falling below the temperature range for guaranteeing the ink quality while carrying out its printing operation. In this heating time period, the ink jet printer can also carries out a printing operation. In order for the inkjet printer to heat the ink and carry out the printing operation simultaneously, its power supply unit needs to supply the inkjet printer with both an electric power for its printing operation and an electric power for the heater.

When the power supply unit has a large capacity, the inkjet printer is supplied with a sufficient electric power for its printing operation and a sufficient electric power for the heater. However, the inclusion of the power supply unit with the large capacity in the inkjet printer causes increase in costs. When a power supply unit with a small capacity is used for the purpose of avoiding the increase in the costs, the small capacity forces the inkjet printer to stand by for starting its printing operation until the temperature of the ink rises up to its predetermined reference temperature beyond the lower limit value of the temperature range for guaranteeing the ink performance. Otherwise, the small capacity forces the power supply unit to supply the heater with an electric power controlled with consideration given to a maximum amount of electric power needed for the printing operation, and thus makes it difficult to increase the electric power to be supplied to the heater. As a result, it takes a longer time before the inkjet printer starts its printing operation.

SUMMARY OF THE INVENTION

An object of the present invention is to provide a printer capable of starting its printing operation within a shorter time while heating the ink up to a predetermined temperature, without entailing increased costs. Another object thereof is to provide a control method of the printer.

To achieve the above object, a first aspect of the present invention is a printer comprising: a printing unit configured to perform printing on a printing sheet by use of ink; a heating unit configured to heat the ink; an ink temperature measuring unit configured to measure an ink temperature; and a control unit configured to control an amount of electric power to be supplied to the heating unit and to control the printing unit, the control unit configured to calculate a coverage rate of a page to be printed and to change the amount of electric power to be supplied to the heating unit depending on the calculated coverage rate, upon a measured value of the ink temperature measured by the ink temperature measuring unit being in a range of a first reference temperature inclusive to a second reference temperature exclusive.

The control unit may continuously or stepwise change the amount of electric power to be supplied to the heating unit such that the amount of electric power decreases as the calculated coverage rate becomes larger.

The control unit may prevent the printing unit from carrying out a printing operation and make the amount of electric power to be supplied to the heating unit larger than a maximum value of the amount of electric power which is changed depending on the calculated coverage rate, upon the measured value of the ink temperature being lower than the first reference temperature.

The control unit may prevent electric power from being supplied to the heating unit and cause the printing unit to carry out a printing operation without calculating the coverage rate of the page to be printed, upon the measured value of the ink temperature being equal to or higher than the second reference temperature.

The control unit may make the amount of electric power to be supplied to the heating unit larger than a maximum value of the amount of electric power which is changed depending on the calculated coverage rate during a time period between completion of printing a preceding printing sheet and start of printing an ensuing printing sheet, upon the measured value of the ink temperature being in the range of the first reference temperature inclusive to the second reference temperature exclusive.

The control unit may set the time period between the completion of printing the preceding printing sheet and the start of printing the ensuing printing sheet longer upon the measured value of the ink temperature being in the range of the first reference temperature inclusive to the second reference temperature exclusive than upon the measured value of the ink temperature being equal to or higher than the second reference temperature.

To achieve the above object, a second aspect of the present invention is a printer comprising: a printing unit configured to perform printing on a printing sheet by use of ink and capable of operating in a normal mode and in a power saving mode of consuming a smaller electric power than in the normal mode; a heating unit configured to heat the ink; an ink temperature measuring unit configured to measure an ink temperature;

and a control unit configured to control an amount of electric power to be supplied to the heating unit and to control the printing unit, the control unit configured to cause the printing unit to operate in the power saving mode and configured to set a first amount of electric power as the amount of electric power to be supplied to the heating unit, upon a measured value of the ink temperature measured by the ink temperature measuring unit being in a range of a first reference temperature inclusive to a second reference temperature exclusive.

The control unit may prevent the printing unit from carrying out a printing operation and set a second amount of electric power which is larger than the first amount of electric power as the amount of electric power to be supplied to the heating unit, upon the measured value of the ink temperature being lower than the first reference temperature.

The control unit may prevent electric power from being supplied to the heating unit and cause the printing unit to operate in the normal mode and carry out a printing operation, upon the measured value of the ink temperature being equal to or higher than the second reference temperature.

A drive frequency of the printing unit may be lower in the power saving mode than in the normal mode.

The printing unit may eject the ink by applying a pulse voltage to a piezoelectric element, a value of the pulse voltage may be smaller in the power saving mode than in the normal mode, and a pulse width may be larger in the power saving mode than in the normal mode.

The printing unit may eject the ink by applying a pulse voltage to a piezoelectric element and express a gradation level of each dot by controlling a number of ink ejection times, a value of the pulse voltage may be smaller in the power saving mode than in the normal mode, and the number of ink ejection times for each dot may be larger in the power saving mode than in the normal mode.

The printing unit may eject the ink by applying a pulse voltage to a piezoelectric element and express a gradation level of each dot by controlling a number of ink ejection times, and the printing unit may avoid use of a dot to be formed by ejecting the ink only once in the power saving mode.

The control unit may change the number of ink ejection times for a dot to be formed by ejecting the ink only once to any one of zero and two in the power saving mode, and change the number of ink ejection times for each of dots in a vicinity of the dot having the changed number of ink ejection times according to the change.

The printer may comprise an ink circulation passage for circulating the ink.

To achieve the above object, a third aspect of the present invention is a control method for a printer, comprising: performing printing on a printing sheet by use of ink by a printing unit; heating the ink by a heating unit; measuring a temperature of the ink by an ink temperature measuring unit; by a control unit, controlling an amount of electric power to be supplied to the heating unit and controlling the printing unit; and by a control unit, calculating a coverage rate of a page to be printed and changing the amount of electric power to be supplied to the heating unit depending on the calculated coverage rate, upon a measured value of the ink temperature measured by the ink temperature measuring unit being in a range of a first reference temperature inclusive to a second reference temperature exclusive.

To achieve the above object, a fourth aspect of the present invention is a control method for a printer, comprising: performing printing on a printing sheet by use of ink by a printing unit, the printing unit being capable of operating in a normal mode and in a power saving mode of consuming a smaller electric power than in the normal mode; heating the ink by a heating unit; measuring a temperature of the ink by an ink temperature measuring unit; by a control unit, controlling an amount of electric power to be supplied to the heating unit and controlling the printing unit; and by a control unit, causing the printing unit to operate in the power saving mode and setting a first amount of electric power as the amount of electric power to be supplied to the heating unit, upon a measured value of the ink temperature measured by the ink temperature measuring unit being in a range of a first reference temperature inclusive to a second reference temperature exclusive.

According to the foregoing configurations, the inkjet printer designed to heat the ink up to the predetermined temperature is capable of starting its printing operation within a shorter time without entailing the increased costs. The foregoing configuration is particularly effective to the printer of an ink-circulation type which circulates the ink.

BRIEF DESCRIPTION OF THE DRAWINGS

FIG. 8A is a diagram showing the width and voltage of a pulse which is applied thereto in normal print mode. FIG. 8B is a diagram showing the width and voltage of a pulse which is applied thereto in the power-saving print mode.

DETAILED DESCRIPTION OF EMBODIMENT

Figure 1:
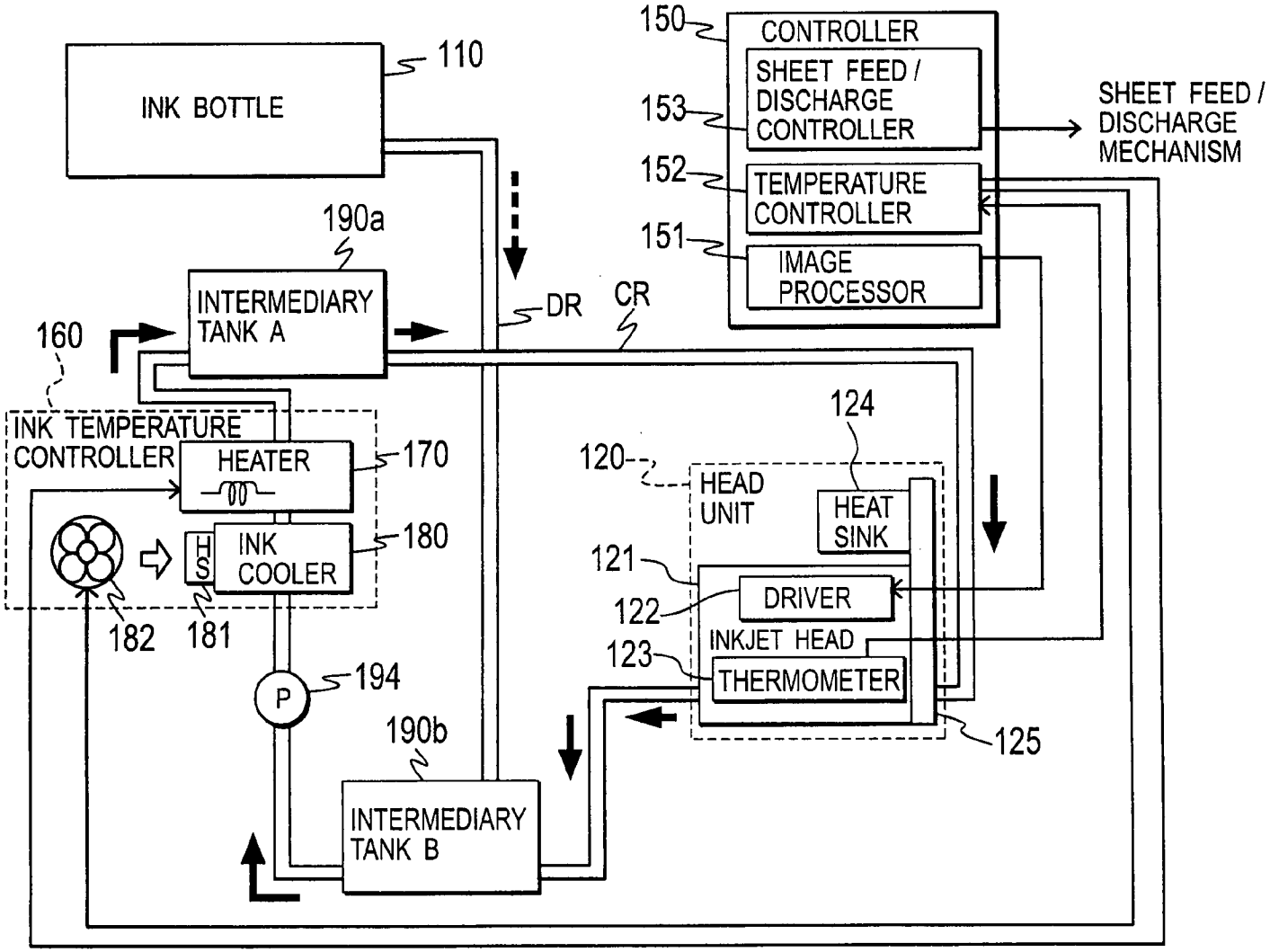
FIG. 1 is a block diagram for explaining ink passages in an inkjet printer according to an embodiment of the present invention.

Descriptions will be provided hereinbelow for the embodiment of the present invention on the basis of the drawings. In the following descriptions for the drawing, the same or similar parts are denoted by the same or similar reference numerals. As shown in FIG. 1, an inkjet printer 100 is a printer which carries out its printing operation by use of ink supplied from an ink bottle 110 detachably attached to the inkjet printer 100. As functional parts concerned with ink passages, a head unit 120, a controller 150, an ink temperature controller 160, an intermediary tank A 190*a*, an intermediary tank B 190*b* and a pump 194 are included in the inkjet printer 100.

The inkjet printer 100 includes a supply passage DR and a circulation CR, each of which is formed of a resin-made pipe, a metal-made pipe or the like. The supply passage DR is connected from the ink bottle 110 to the intermediary tank B 190*b*. The circulation passage CR starts in the intermediary tank B 190*b*, passages the intermediary tank A 190*a* and the head unit 120, as well as returns to the intermediary tank B 190*b*.

The ink supplied from the ink bottle 110 flows through the supply passage DR, and subsequently is reserved in the intermediary tank B 190*b* for the time being. In the circulation passage CR, the ink reserved in the intermediary tank B 190*b* is sent to the intermediary tank A 190*a* by the pump 194, and subsequently is guided to the head unit 120. Ink which is not used in the head unit 120 is returned to the intermediary tank B 190*b*. The inkjet printer 100 employs a system in which the ink is circulated through the circulation passage CR in this manner. Nevertheless, the present invention is applicable to an inkjet printer employing a system in which no ink is circulated as well.

The ink temperature controller 160 provided between the intermediary tank B 190*b* and the intermediary tank A 190*a* is a mechanism configured to cause the ink to be heated and cooled depending on the temperature of the ink. To this end, the ink temperature controller 160 includes: a heater 170 configured to heat the ink; and an ink cooler 180 configured to cool the ink. The ink cooler 180 includes a heat sink 181. A fan 182 configured to enhance the cooling effect is provided in a vicinity of the heat sink 181 of the ink cooler 180.

The head unit 120 includes an inkjet head 121 in which multiple nozzles for ejecting the ink are provided. In the present embodiment, it is assumed that the head is of a type which ejects the ink by use of a piezoelectric element. The inkjet head 121 includes: a driver 122 configured to control the ejection of the ink from each nozzle by driving the piezoelectric element on the basis of a signal transmitted from the controller 150; and a thermometer 123 configured to measure the temperature of the ink.

The driver 122 and the piezoelectric element generate heat through their operations. For the purpose of checking the influence and the like of the heats on the ink, the head unit 120 is provided with a heat sink 124. The heat sink 124 is mounted on the inkjet head 121 through a mounting plate 125. For the purpose of enhancing the cooling effect, a fan may be provided in a vicinity of the heat sink 124.

The controller 150 is a functional unit configured to control the printing process, electric power supply, and other processes carried out in the inkjet printer 100. The controller 150 is configured of a CPU (central processing unit), memories and the like, which are not illustrated. In the present embodiment, the controller 150 includes: an image processor 151 configured to calculate an amount of ink ejected for each dot on the basis of an image to be printed, and to output the amount of ink thus calculated to the driver 122 of the head unit 120; a temperature controller 152 configured to manage and control the temperature of the ink; and a sheet feed/discharge controller 153 configured to control the feed and discharge of printing sheets by the a sheet feed/discharge mechanism, which is not illustrated. The temperature controller 152 manages and controls the temperature of the ink by controlling the drive of the fan 182 provided in the vicinity of the heater 170 and the ink cooler 180 on the basis of a measured value from the thermometer 123 of the head unit 120.

FIG. 1 shows a case where only one type of ink is used. However, multiple color inks may be used for the inkjet printer to carry out a color printing operation and, therefore multiple ink passages may be respectively provided for the multiple color inks.

In the inkjet printer 100 according to the present embodiment, the temperature range for guaranteeing the printing performance is defined as 20° C. to 45° C. in terms of the temperature of the ink which the temperature 123 measures. To this end, the controller 150 suspends the printing operation, and instead causes the ink to be circulated, as well as causes the ink to be cooled by driving the fan 182, for example, when the measured value of the ink temperature measured by the thermometer 123 is higher than 45° C. Subsequently, when the ink is cooled in a way that the measured value of the ink temperature falls to or below 45° C., the controller 150 resumes the printing operation. Note that 20° C. to 45° C. is applicable to the present embodiment only. The range of the measured value of the ink temperature which guarantees the printing performance is not limited to 20° C. to 45° C.

On the other hand, in a case where the measured value of the ink temperature is lower than 20° C. when the inkjet printer starts its printing operation, the controller 150 holds the inkjet printer from carrying out the printing operation, and instead causes the ink to be circulated, as well as causes the heater 170 to heat the ink. After the measured value of the ink temperature comes equal to or higher than 20° C., the controller 150 causes the inkjet printer to start the printing operation. The controller 150 is designed not to stop the ink from being heated when and after the measured value of the ink temperature rises to 20° C. or higher, and to cause the heater 170 to continue heating the ink until the measured value of the ink temperature comes equal to 25° C. During this time period, the ink is heated while the printing process is carried out.

The inkjet head 121 and the heater 170 are supplied with their respective electric powers from a power supply unit, which is not illustrated. In a case where a power supply unit of a smaller size is used, the power supply unit is incapable of supplying a sufficient electric power to the inkjet head 121 and the heater 170. This makes it more important for the inkjet printer to make a balanced control when causing the heater 170 to heat the ink and carrying out the printing operation simultaneously. With this importance taken into consideration, in the present invention, the following controls according to a first example and a second example are made.

First Example

Figure 2:
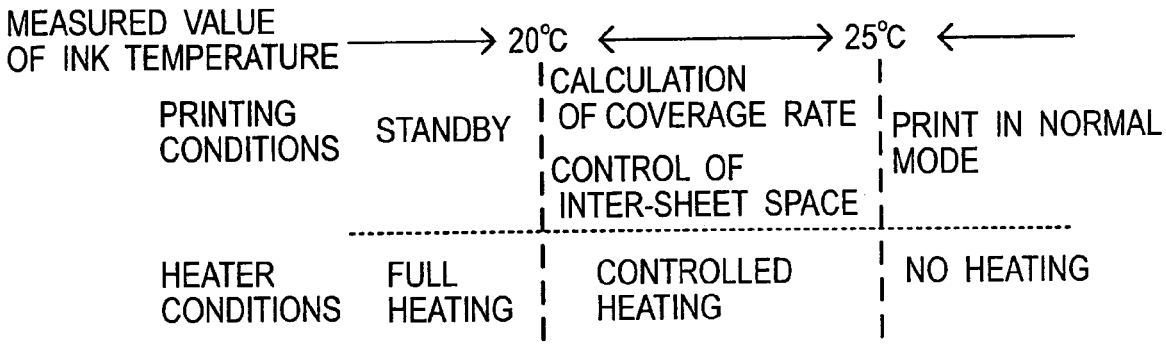
FIG. 2 is a diagram showing an outline of a process according to a first example of the present invention.

Descriptions will be provided for the first example. FIG. 2 shows a relationship among a measured value of the ink temperature (shown in the uppermost row in FIG. 2), a printing condition (the middle row in FIG. 2) and an operating condition of the heater 170 (the lowermost row in FIG. 2). In the first example, as shown in FIG. 2, when the measured value of the ink temperature is lower than 20° C., the inkjet printer enters standby mode without carrying out any actual printing operation, and the heater 170 heats the ink with a maximum amount of electric power which can be supplied to the heater 170 (in full heating mode) by the power supply unit. At this time, the ink is circulated in the circulation passage CR. This makes it possible to increase the ink temperature rise rate, and accordingly to shorten the time for which the inkjet printer stands by for starting the printing operation as much as possible. It goes without saying that the maximum amount of electric power which can be supplied to the heater 170 should be determined with consideration being given to the amount of power to be supplied to the other functional units, its margin and the like.

Once the measured value of the ink temperature rises to 20° C. or higher, the inkjet printer starts the printing operation. In this case, the printing process includes: calculation of a coverage rate for each page; and control of a space between each two consecutive sheets in order that each inter-sheet space should be larger than usual. No specific restriction is imposed on the method of calculating the coverage rate, and various methods can be used. For example, the coverage rate can be obtained by calculating the ratio of the area of a range in which ink is ejected to the area of a sheet to be printed. While the inkjet printer is actually carrying out the printing operation, the heater 170 heats the ink with an electric power which is determined depending on the coverage rate thus calculated. Specifically, in a case where the coverage rate is higher, the amount of electric power consumed by the inkjet head 121 increases. For this reason, the power supply unit decreases the amount of electric power supplied to the heater 170. In a case where the coverage rate is lower, the amount of electric power consumed by the inkjet head 121 decreases. For this reason, the power supply unit increases the amount of electric power supplied to the heater 170. This scheme makes it possible for the inkjet printer to efficiently carry out the printing process and to cause the electric power to be supplied to the heater 170 within the electric power supply capacity of the power supply unit. During a time corresponding to each inter-sheet space, the power supply unit increases an electric power supplied to the heater 170 because the inkjet printer carries out no printing operation. When an inter-sheet space is set longer than usual, it is possible to increase the ink temperature rise rate. Nevertheless, the process may be carried out during the time corresponding to each inter-sheet space as usual.

Once the measured value of the ink temperature comes equal to or higher than 25° C., the power supply unit stops supplying the electric power to the heater 170. In addition, the inkjet printer carries out a normal printing process without calculating the coverage rate or controlling the inter-sheet space. This makes it possible to carry out the printing process quickly.

Figure 3:
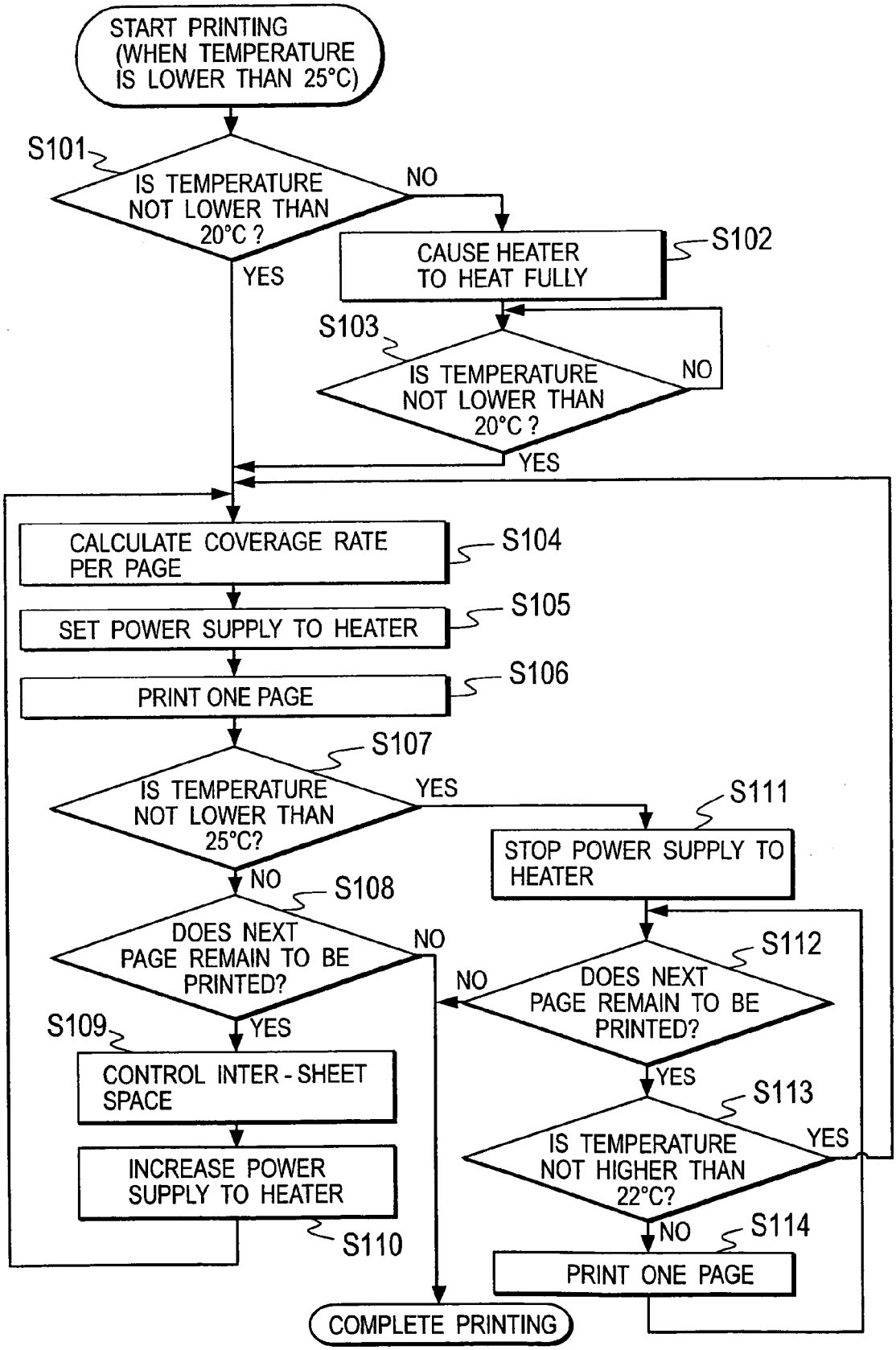
FIG. 3 is a flowchart for explaining a concrete flow of the process according to the first example of the present invention.

A flowchart of FIG. 3 shows how the process is carried out in the case where the measured value of the ink temperature is lower than 25° C. when the inkjet printer starts a printing operation. In this case, first of all, it is determined whether or not the measured value of the ink temperature is equal to or higher than 20° C. (step S101). In a case where the result of the determination is that the measured value is lower than 20° C. (No in step S101), the heater 170 heats the ink by heating the ink with a maximum amount of electric power which can be supplied to the heater 170 by the power supply unit (step S102). During this time, the ink is circulated in the circulation passage CR. In addition, the inkjet printer stands by without starting the actual printing operation until the measured value of the ink temperature rises to 20° C. or higher (step S103).

In the case where the measured value of the ink temperature is equal to or higher than 20° C. (Yes in step S101, and in the case of Yes in step S103), the image processor 151 in the controller 150 calculates the coverage rate for a page to be printed before the inkjet printer starts to print the page (step S104). Depending on the coverage rate thus calculated, the controller 150 sets up the electric power to be supplied to the heater 170 (step S105). For each coverage rate, the electric power to be supplied to the heater 170 can be set at a predetermined value in a way that, as the coverage rate becomes higher, the electric power to be supplied to the heater 170 decreases continuously or stepwise. Depending on this setting, the power supply unit supplies an electric power to the heater 170. Thus, the inkjet printer prints the page (step S106).

The controller 150 monitors whether or not the measured value of the ink temperature rises to 25° C. or higher (step S107). In the case where the measured value of the ink temperature is lower than 25° C. (No in step S107), the controller 150 determines whether or not there remains a page to be subsequently printed (step S108). In the case where no page remains to be subsequently printed (No in step S108), the controller 150 causes the inkjet printer to terminate its printing process.

In the case where the page remains to be subsequently printed (Yes in step S108), the controller 150 controls the inter-sheet space (step S109). Specifically, the controller 150 sets the space between two consecutive printing sheets to be fed longer than usual. Until the controller 150 sets up an electric power to be supplied to the heater 170 when the inkjet printer prints the next page (step S105), the controller 150 causes the power supply unit to supply a larger electric power to the heater 170 (step S110). Subsequently, the step of calculating a coverage rate (step S104) and its ensuing steps are repeated for the next page to be processed.

In the case where the measured value of the ink temperature rises to 25° C. or higher as a result of the heating of the ink by the heater 170 (Yes in step S107), the controller 150 causes the power supply unit to stop supplying the electric power to the heater 170, and thus causes the heater 170 to complete heating the ink (step S111). As long as there remains a page to be subsequently printed, (Yes in step S112), the printing process is repeatedly carried out as usual (step S114). At this time, the coverage rate need not be calculated, and the inter-sheet space need not be controlled. In the case where, however, the measured value of the ink temperature falls to or below a predetermined value, for example, 22° C. due to a lower ambient temperature or the like (Yes in step S113), the controller 150 returns to the step of calculating a coverage rate (step S104), and subsequently causes the heater 170 to heat the ink while carrying out the ensuing steps once again, for the purpose of not allowing the measured value of the ink temperature to fall to or below 20° C.

Figure 4:
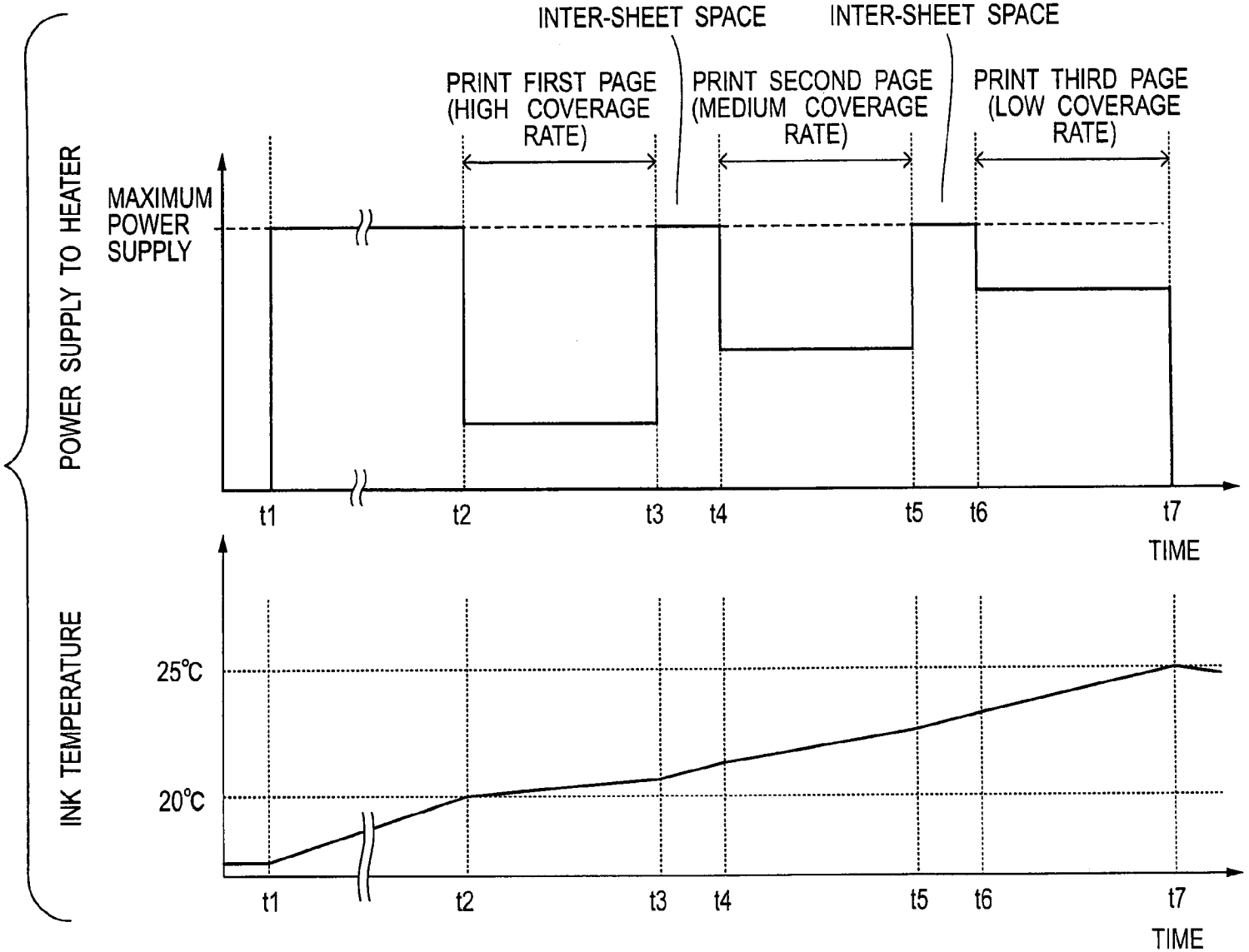
FIG. 4 is a diagram showing an example of a relationship between an electric power supplied to a heater and a measured value of an ink temperature.

FIG. 4 is a diagram showing an example of a relationship between an electric power (a heater electric power) to be supplied to the heater 170 and a measured value of the ink temperature according to the first example. Vertical axes indicate the heater electric power and the temperature of the ink, respectively. Horizontal axes each indicate time. For the purpose of making the relationship understood easily, change in the temperature of the ink is emphasized.

If the measured value of the ink temperature is equal to or lower than 20° C. at time t1 when the inkjet printer starts a printing operation, the controller 150 causes the inkjet printer to start no actual printing operation, but causes the heater 170 to heat the ink with a maximum amount of electric power which can be supplied to the heater 170. As a result, once the measured value of the ink temperature reaches 20° C. at time t2, the controller 150 causes the inkjet printer to start the actual printing operation. At this time, if the coverage rate for the first sheet is higher, the controller 150 controls the power supply unit in order to decrease an electric power to be supplied to the heater 170 because the actual printing operation increases an electric power consumed by the inkjet head 121. As result, the temperature of the ink rises slower. Once the inkjet printer completes printing the first sheet at time t3, the controller 150 causes the heater 170 to heat the ink with a maximum amount of electric power which can be supplied to the heater 170 for a time period corresponding to an inter-sheet space between time t3 and time t4 when the inkjet printer starts to print the second sheet. This accelerates the rise of the temperature of the ink. At this time, the controller 150 sets the inter-sheet space longer than usual.

If the coverage rate for the second sheet is medium, the controller 150 controls the power supply unit in order that the power supply unit should supply a medium electric power to the heater 170. As a result, the temperature of the ink rises slightly slower. Once the inkjet printer completes printing the second sheet at time t5, the controller 150 causes the heater 170 to heat the ink with a maximum amount of electric power which can be supplied to the heater 170 for a time period corresponding to an inter-sheet space between time t5 and time t6 when the inkjet printer starts to print the third sheet. This accelerates the rise of the temperature of the ink. At this time, the controller 150 sets the inter-sheet space longer than usual, as well.

If the coverage rate for the third sheet is lower, the controller 150 controls the power supply unit in order to increase an electric power to be supplied to the heater 170, because the inkjet head 121 consumes a smaller electric power. If the measured value of the ink temperature reaches 25° C. at time t7 when the inkjet printer completes printing the third sheet, the controller 150 causes the power supply unit to stop supplying the electric power to the heater 170, and the inkjet printer enters normal print mode.

Second Example

Figure 5:
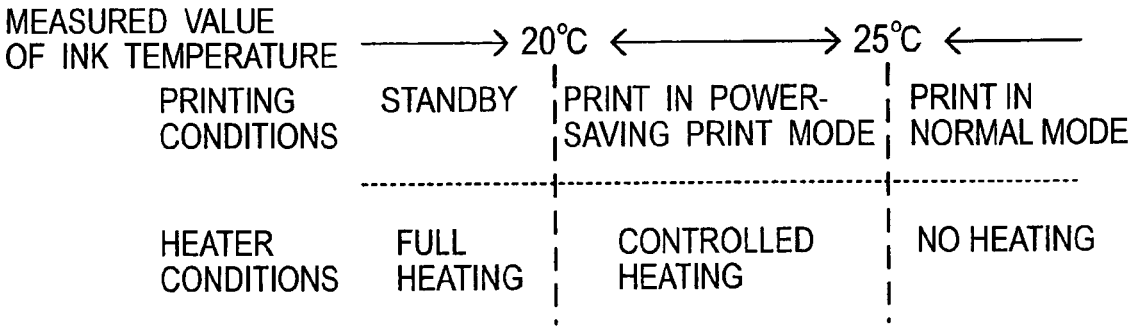
FIG. 5 is a diagram showing an outline of a process according to a second example of the present invention.

Next, descriptions will be provided for the second example. FIG. 5 shows a relationship among a measured value of the ink temperature (shown in the uppermost row in FIG. 5), a printing condition (the middle row in FIG. 5) and an operating condition of the heater 170 (the lowermost row in FIG. 5). In the second example, as shown in FIG. 5, when the measured value of the ink temperature is lower than 20° C., the inkjet printer is put in standby mode without carrying out any actual printing operation, and the heater 170 heats the ink with a maximum amount of electric power which can be supplied to the heater 170 by the power supply unit, like in the first example. At this time, the ink is circulated in the circulation passage CR. This makes it possible to increase the ink temperature rise rate, and accordingly to shorten the time for which the inkjet printer stands by for starting the printing operation as much as possible. It goes without saying that the maximum amount of electric power which can be supplied to the heater 170 should be determined with consideration being given to the amount of power to be supplied to the other functional units, its margin and the like.

Once the measured value of the ink temperature rises to 20° C. and more, the inkjet printer starts a printing process. For the printing process of this case, the inkjet printer carries out the power-saving print mode which causes the inkjet printer to consume a smaller electric power than the normal print mode. During the actual printing operation, the heater 170 heats the ink with an electric power supplied to the heater 170 with consideration being given to a maximum amount of electric power which the power supply unit can supply to the heater 170 and an electric power needed for the inkjet printer to carry out the power-saving print mode. For example, the electric power with which the heater 170 heats the ink may be set at a value obtained by subtracting an electric power which the inkjet head 121 consumes in the power-saving print mode from a maximum amount of electric power which can be supplied to the heater 170 by the power supply unit. This makes it possible for the inkjet printer to cause the power supply unit to increase the electric power to be supplied to the heater 170 while carrying out the printing operation. For this reason, the inkjet printer is capable of efficiently carrying out the printing process and causing the electric power to be supplied to the heater 170 within the maximum electric power supply capacity of the electric power unit. Descriptions will be provided for concrete contents of the power-saving print mode.

Thereafter, once the measured value of the ink temperature rises to 25° C. or higher, the controller 150 causes the power supply unit to stop supplying the electric power to the heater. In addition, the inkjet printer carries out the printing process in normal mode without calculating the coverage rate or controlling the inter-sheet space. This makes it possible for the printing process to be carried out quickly.

Figure 6:
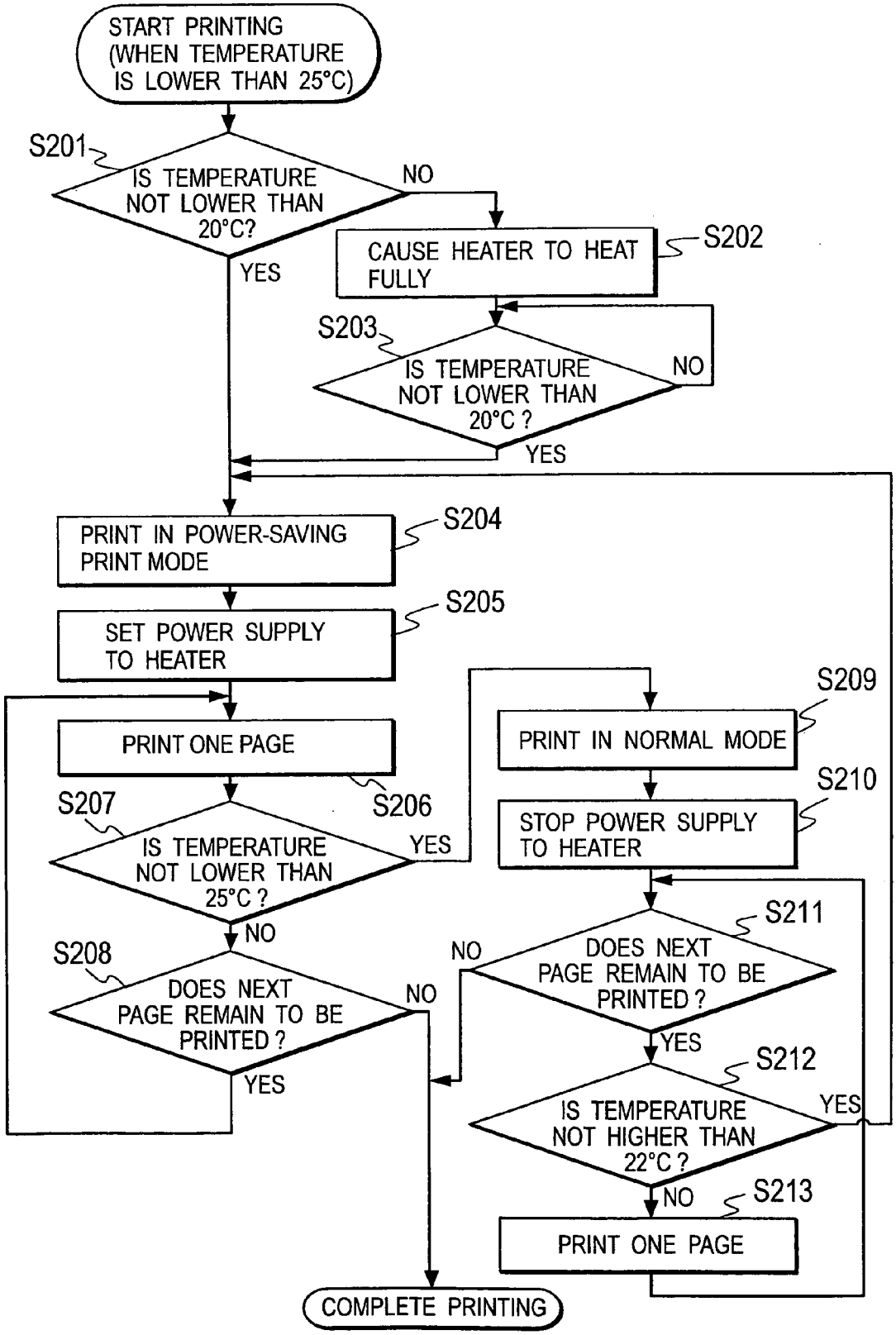
FIG. 6 is a flowchart for explaining a concrete flow of the process according to the second example of the present invention.

The flowchart of FIG. 6 shows how a process is carried out in a case where the measured value of the ink temperature is lower than 25° C. when the inkjet printer starts a printing operation. In this case, first of all, it is determined whether or not the measured value of the ink temperature is equal to or higher than 20° C. (step S201). In a case where the result of the determination is that the measured value is lower than 20° C. (No in step S201), the heater 170 heats the ink by heating the ink with a maximum amount of electric power which can be supplied to the heater 170 by the power supply unit (step S202). During this time, the ink is circulated in the circulation passage CR. In addition, the inkjet printer stands by without starting the actual printing operation until the measured value representing the temperature of the ink rises to 20° C. or higher (step S203).

In the case where the measured value representing the temperature of the ink is equal to or higher than 20° C. (Yes in step S201, and Yes in step S203), the inkjet printer is put in power-saving print mode (step S204). Subsequently, an electric power to be supplied to the heater 170 is set up (step S205). As described above, a value corresponding to the power-saving print mode is set up as the electric power to be supplied to the heater 170. The power supply unit supplies the heater 170 with an electric power based on this setting. Thereafter, the inkjet printer prints the page (step S206).

The controller 150 monitors whether the measured value of the ink temperature rises to 25° C. or more (step S207). In the case where the measured value of the ink temperature does not reach 25° C. (No in step S207), the controller 150 determines whether or not there remains a page to be subsequently printed (step S208). In the case where no page remains to be subsequently printed (No in step S208), the controller 150 causes the inkjet printer to terminate its printing process. In the case where the page remains to be subsequently printed (Yes in step S208), the controller 150 causes the inkjet printer to print the subsequent page while continuing to put the inkjet printer in the power-saving print mode (step S206).

In the case where, as a result of the heating of the ink by the heater 170, the measured value of the ink temperature rises to 25° C. or higher (Yes in step S207), the controller 150 causes the inkjet printer to terminate the power-saving print mode, and puts the inkjet printer in the normal print mode (step S209). In the normal print mode, the controller 150 causes the power supply unit to stop supplying the electric power to the heater 170, and thus causes the heater 170 to stop heating the ink (step S210). As long as there is a page which remains to be subsequently printed (Yes in step S211), the printing process is repeatedly carried out as usual (step S213). In the case where the measured value of the ink temperature falls to a predetermined value, for example to 22° C. or less due to the lower ambient temperature (Yes in step S212) or the like, the controller 150 once again puts the inkjet printer in the power-saving print mode (step S204) lest the measured value of the ink temperature should fall to 20° C. or below, and causes the ink to be heated by the heater 170.

Figure 7:
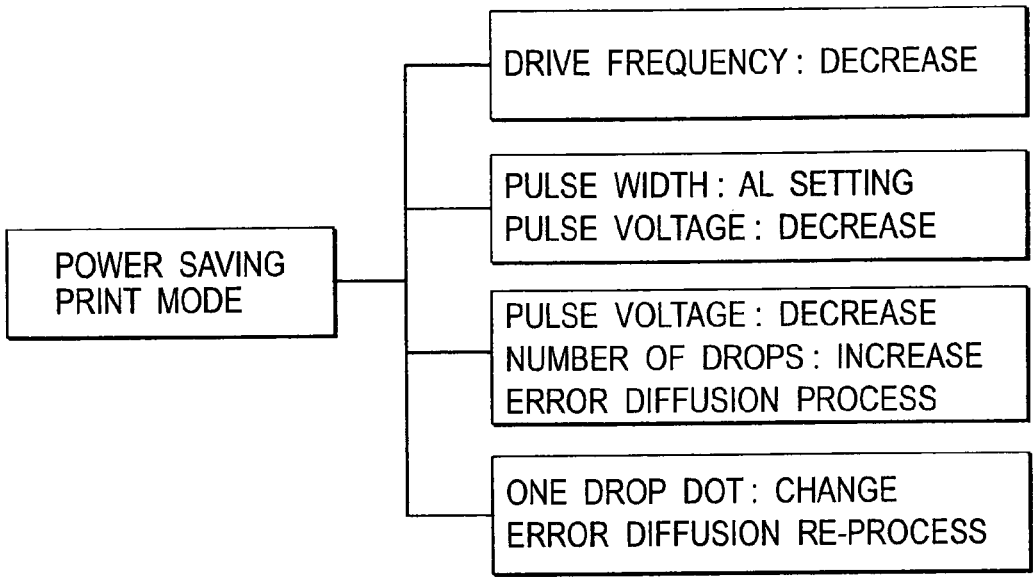
FIG. 7 is a diagram for explaining a scheme for realizing power-saving print mode according to the second example of the present invention.

Next, descriptions will be provided for how the power-saving print mode is carried out. The inkjet printer according to the second example is provided with the power-saving print mode for the purpose of reducing the electric power which the inkjet head 121 consumes in printing. As shown in FIG. 7, four schemes are designed to be used for the power-saving print mode. These schemes may be used solely or in combination. Furthermore, schemes to be used for the power-saving print mode are not limited to these four schemes, and any other scheme may be used for the power-saving print mode. Incidentally, the printing speed may be lower in the power-saving print mode than in the normal print mode. In response to this, the sheet feeding speed is controlled, and the image processing speed is controlled. Furthermore, the print finishing quality may be lower in the power-saving print mode than in the normal print mode. With this taken into consideration, the inkjet printer may be designed to be capable of receiving a user's instruction for prohibiting the inkjet printer to be put in the power-saving print mode in such a case where the user gives priority to the print quality.

A first scheme to be used for the power-saving print mode is to decrease the drive frequency of the inkjet head 121. The inkjet head 121 drives with a predetermined frequency. In general, the electric power consumption in the inkjet head 121 decreases as the driving speed of the inkjet head 121 becomes lower. For this reason, in the power-saving print mode, it is possible to decrease the electric power consumption in the inkjet printer 121 by reducing the drive frequency of the inkjet head 121 lower than usual.

Figure 8A:
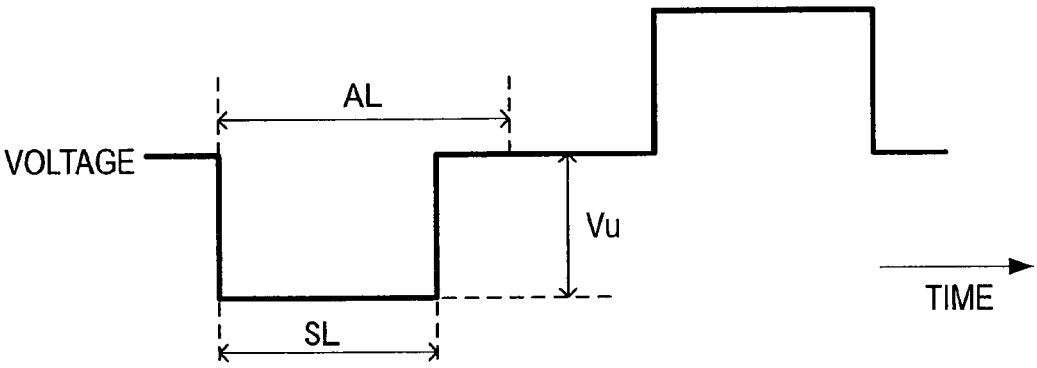
FIGS. 8A and 8B are diagrams each showing a width and voltage of a pulse applied to a piezoelectric element according to the second example of the present invention.
Figure 8B:
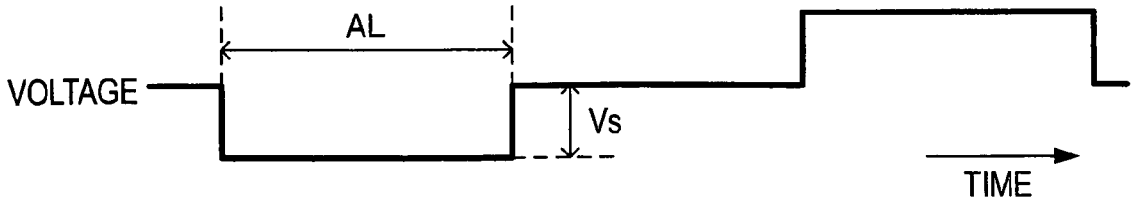

A second scheme to be used for the power-saving print mode is to optimize the width of the pulse to be applied to a piezoelectric element, and thus to decrease the pulse voltage. By this, the electric power consumption in the inkjet head 121 is decreased. It is known that, when the width of a pulse to be applied to the piezoelectric element is synchronized with the vibration period which is termed "AL," and which is particular to the inkjet head 121, the ink is ejected most efficiently so that it is thus possible to minimize the applied voltage as long as the inkjet head 121 ejects the same amount of ink (see Japanese Patent Application Publication No. 2002-19103). In each of FIGS. 8A and 8B, the vertical axis indicates voltage, and the horizontal axis indicates time. In general, when the inkjet printer carries out a normal printing operation, priority is given to the printing speed. For this reason, the piezoelectric element is driven with a pulse width SL narrower than AL as shown in FIG. 8A, and the applied voltage Vu is increased accordingly. By contrast, in the power-saving print mode, as shown in FIG. 8B, the pulse width of a pulse to be applied to the piezoelectric element is made equal to AL, and the applied voltage Vs is accordingly made smaller than the normal applied voltage Vu. Thereby, the electric power consumption in the inkjet head 121 is decreased.

A third scheme to be used for the power-saving print mode is to decrease the voltage of the pulse to be applied to the piezoelectric element. Thereby, the electric power consumption in the inkjet head 121 is decreased. In this case, a decreased amount of ink is ejected for each ejection. With this taken into consideration, the number of times the inkjet head 121 ejects ink for a particular dot (the number of drops) are increased. In other words, the inkjet printer 100 controls the number of drops for the purpose of representing a gradation level for each dot. Specifically, when the inkjet printer 100 represents a darker color for a particular dot, the inkjet printer 100 increases the number of drops for the particular dot. When the inkjet printer 100 represents a lighter color for a particular color, the inkjet printer decreases the number of dots for the particular dot. The third scheme is to decrease the voltage to be applied to the piezoelectric element for the purpose of reducing the electric power consumption in the inkjet head 121, and to increase the number of drops for a particular dot in exchange for the reduction in the amount of ink to be ejected for each drop. As a result, the maximum number of drops is increased for each drop. In addition, although the number of drops is increased for each drop, it is possible to decrease the overall electric power consumption in the inkjet head 121 because the inkjet head 121 is capable of ejecting the ink with a lower voltage. In order for the inkjet printer to carry out this process, the image processor 151 or the driver 122 converts the normal number of drops calculated on the basis of the image data to the number of drops for the power-saving print mode by use of an error diffusion process.

A fourth scheme to be used for the power-saving print mode is to increase the efficiency with which drops are ejected. Thereby, the electric power consumption in the inkjet head 121 is decreased. As described above, the inkjet printer 100 controls the number of drops for each dot for the purpose of representing a gradation level for the dot. In general, the efficiency with which the ink is ejected is lower when one dot is formed with one drop than when one dot is formed with multiple drops. For example, the electric power consumption in the inkjet head 121 for a single drop when one dot is formed with the single drop is larger than the electric power consumption in the inkjet head 121 for each of multiple drops when one dot is formed with the multiple drops. With this taken into consideration, the fourth scheme to be used for the power-saving print mode is to convert the number of drops from one, specifically, to zero or two for a particular dot which is usually designed to be formed with one drop with less efficiency. For this control purpose, in a case where the number of drops for the particular dot is converted from one to zero, the number of drops for each dot in the vicinity of the particular dot is increased. In a case where the number of drops for the particular dot is converted from one to two, the number of drops for each dot in the vicinity of the particular dot is decreased. To this end, the image processor 151 is designed to carry out the error diffusion process.

The inkjet printer 100 may be configured to carry out any one of the control shown for the first example and the control shown for the second example. Otherwise, the inkjet printer 100 may be configured to carry out a combination of the control shown for the first example and the control shown for the second example.

The printer and the control method thereof according to the embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiment of the present invention are only a list of optimum effects achieved by the present invention. Hence, the effects of the present invention are not limited to those described in the embodiment of the present invention.

What is claimed is:

1. A printer comprising:

a printing unit configured to perform printing on a printing sheet by use of ink;

a heating unit provided separately from the printing unit and configured to heat the ink;

an ink temperature measuring unit configured to measure an ink temperature; and a control unit configured to control an amount of electric power supplied to the heating unit and to control an amount of electric power supplied to the printing unit, the control unit configured to calculate, prior to printing of pages to be printed by the printing unit, a coverage rate of the page to be printed and to change the amount of electric power supplied to the heating unit depending on the calculated coverage rate, upon a measured value of the ink temperature measured by the ink temperature measuring unit being equal to or more than a first reference temperature and less than a second reference temperature.

2. The printer according to claim 1, wherein the control unit continuously or stepwise changes the amount of electric power to be supplied to the heating unit such that the amount of electric power decreases as the calculated coverage rate becomes larger.

3. The printer according to claim 1, wherein the control unit prevents the printing unit from carrying out a printing operation and makes the amount of electric power supplied to the heating unit larger than a maximum value of the amount of electric power supplied to the heating unit at a time of printing by the printing unit, upon the measured value of the ink temperature being lower than the first reference temperature.

4. The printer according to claim 1, wherein the control unit prevents electric power from being supplied to the heating unit and causes the printing unit to carry out a printing operation without calculating the coverage rate of the page to be printed, upon the measured value of the ink temperature being equal to or higher than the second reference temperature.

5. The printer according to claim 1, wherein, during the time period between completion of printing a preceding printing sheet and start of printing an ensuing printing sheet, upon the measured value of the ink temperature being equal to or more than the first reference temperature and less than the second reference temperature, the control unit causes the amount of electric power supplied to the heating unit to be larger than a maximum value of the amount of electric power supplied to the heating unit at a time of printing by the printing unit.

6. The printer according to claim 1, wherein the control unit sets the time period between the completion of printing the preceding printing sheet and the start of printing the ensuing printing sheet longer upon the measured value of the ink temperature being equal to or more than the first reference temperature and less than the second reference temperature than upon the measured value of the ink temperature being equal to or higher than the second reference temperature.

7. The printer according to claim 1, further comprising:

an ink circulation passage for circulating the ink.

8. A control method for a printer, comprising:

performing printing on a printing sheet by use of ink by a printing unit;

heating the ink by a heating unit provided separately from the printing unit;

measuring a temperature of the ink by an ink temperature measuring unit;

by a control unit, controlling an amount of electric power supplied to the heating unit and controlling an amount of electric power supplied to the printing unit; and by a control unit, calculating, prior to printing of pages to be printed by the printing unit, a coverage rate of the page to be printed and changing the amount of electric power supplied to the heating unit depending on the calculated coverage rate, upon a measured value of the ink temperature measured by the ink temperature measuring unit being equal to or more than a first reference temperature and less than a second reference temperature.

9. The control method according to claim 8, wherein, during the time period between completion of printing a preceding printing sheet and start of printing an ensuing printing sheet, upon the measured value of the ink temperature being equal to or more than the first reference temperature and less than the second reference temperature, the control unit causes the amount of electric power supplied to the heating unit to be larger than a maximum value of the amount of electric power supplied to the heating unit at a time of printing by the printing unit.

10. The control method according to claim 9, wherein the control unit sets the time period between the completion of printing the preceding printing sheet and the start of printing the ensuing printing sheet longer upon the measured value of the ink temperature being equal to or more than the first reference temperature and less than the second reference temperature than upon the measured value of the ink temperature being equal to or higher than the second reference temperature.

11. The control method according to claim 8, wherein upon sensing the predetermined conditions, during a time between printing of the two consecutive sheets, the power supply unit increases electric power supplied to the heater.

12. The printer according to claim 1, wherein upon sensing the predetermined conditions, during a time between printing of the two consecutive sheets, the power supply unit increases electric power supplied to the heater.

13. The control method according to claim 8 wherein the control unit continuously or stepwise changes the amount of electric power to be supplied to the heating unit such that the amount of electric power decreases as the calculated coverage rate becomes larger.

14. The control method according to claim 8, wherein the control unit prevents the printing unit from carrying out a printing operation and makes the amount of electric power supplied to the heating unit larger than a maximum value of the amount of electric power supplied to the heating unit at a time of printing by the printing unit, upon the measured value of the ink temperature being lower than the first reference temperature.

15. The control method according to claim 8, wherein the control unit prevents electric power from being supplied to the heating unit and causes the printing unit to carry out a printing operation without calculating the coverage rate of the page to be printed, upon the measured value of the ink temperature being equal to or higher than the second reference temperature.

16. The control method according to claim 8, further comprising: an ink circulation passage for circulating the ink.

17. The control method of claim 8, wherein the control unit is configured to change depending on the calculated coverage rate, the amount of electric power supplied to the heating unit at a time of printing of the pages to be printed by the printing unit.

18. The printer according to claim 1, wherein the control unit is configured to change, depending on the calculated coverage rate, the amount of electric power supplied to the heating unit at a time of printing of the pages to be printed by the printing unit.

19. The control method according to claim 8, wherein the control unit is configured to change, depending on the calculated coverage rate, the amount of electric power supplied to the heating unit within an electric power supply capacity of a power supply unit.

20. The printer according to claim 1, wherein the control unit is configured to change, depending on the calculated coverage rate, the amount of electric power supplied to the heating unit within an electric power supply capacity of a power supply unit.

* * * * *